US007679588B2

(12) United States Patent
Kim et al.

(10) Patent No.: US 7,679,588 B2
(45) Date of Patent: Mar. 16, 2010

(54) DISPLAY DEVICE AND METHOD OF DRIVING THE SAME

(75) Inventors: Hak Su Kim, Seoul (KR); Su Jin Baek, Geoje-shi (KR)

(73) Assignee: LG Display Co., Ltd., Seoul (KR)

( * ) Notice: Subject to any disclaimer, the term of this patent is extended or adjusted under 35 U.S.C. 154(b) by 708 days.

(21) Appl. No.: 11/637,777

(22) Filed: Dec. 13, 2006

(65) Prior Publication Data

US 2008/0122823 A1 May 29, 2008

(30) Foreign Application Priority Data

Aug. 29, 2006 (KR) ..... 10-2006-0082360

(51) Int. Cl.
*G09G 3/32* (2006.01)

(52) U.S. Cl. ..... 345/82

(58) Field of Classification Search ..... 345/82
See application file for complete search history.

(56) References Cited

U.S. PATENT DOCUMENTS 5,642,027 A * 6/1997 Windes et al. ..... 320/166
2003/0025655 A1 2/2003 Ochi et al.
2004/0085025 A1 5/2004 Maede et al.
2005/0052448 A1 3/2005 Hayafuji et al.

FOREIGN PATENT DOCUMENTS

| | | |
|---|---|---|
| EP | 1 176 580 | 11/2002 |
| EP | 1 536 404 | 6/2005 |
| JP | 2005-227337 | 8/2005 |
| KR | 10-2004-0029221 A | 4/2004 |

OTHER PUBLICATIONS

Korean Office Action dated Sep. 14, 2007.

* cited by examiner

*Primary Examiner*—Richard Hjerpe
*Assistant Examiner*—Andrew Schnirel
(74) *Attorney, Agent, or Firm*—Morgan Lewis & Bockius LLP

(57) ABSTRACT

The present invention relates to a display device for providing charges discharged from data lines to a battery. The display device includes data lines, scan lines, pixels, a charge storing circuit and a discharging circuit. The pixels are formed in cross areas of the data lines and the scan lines, and driven on the basis of a driving voltage. The charge storing circuit is coupled to at least one data line during a first sub-discharge time of a discharge time, and stores electric charges discharged from the data line during the first sub-discharge time. The discharging circuit is coupled to the data line during a second sub-discharge time of the discharge time, and discharges the data line up to a certain discharge voltage during the second sub-discharge time.

10 Claims, 10 Drawing Sheets

DISPLAY DEVICE AND METHOD OF DRIVING THE SAME

CROSS-REFERENCE TO RELATED APPLICATIONS

This application claims priority from Korean Patent Application No. 2006-82360, filed on Aug. 29, 2006, the contents of which are incorporated herein by reference in its entirety.

BACKGROUND OF THE INVENTION

1. Field of the Invention

The present invention relates to a display device and a method of driving the same. More particularly, the present invention relates to a display device for providing a charge discharged from data lines to a battery and a method of driving the same.

2. Description of the Related Art

A display device displays a certain image, and especially an organic electroluminescent device is a self light emitting device.

FIG. 1 is a view illustrating a common display device.

In FIG. 1, the display device includes a panel 100, a controller 102, a first scan driving circuit 104, a second scan driving circuit 106, a discharging circuit 108, a precharging circuit 110, a data driving circuit 112, a battery 114 and a DC-DC circuit 116.

The panel 100 includes a plurality of pixels E11 to E44 formed in cross areas of data lines D1 to D4 and scan lines S1 to S4.

The controller 102 receives display data from an outside apparatus (not shown), and controls the scan driving circuits 104 and 106, the precharging circuit 110, and the data driving circuit 112 by using the received display data.

The first scan driving circuit 104 transmits first scan signals to some of the scan lines S1 to S4, e.g. S1 and S3 under control of the controller 102.

The second scan driving circuit 106 transmits second scan signals to the other scan lines S2 and S4 under control of the controller 102. As a result, the scan lines S1 to S4 are connected in sequence to a ground.

The discharging circuit 108 has switches SW1 to SW4 and a zener diode ZD, and discharges the data lines D1 to D4 up to the voltage of the zener diode ZD during a discharge time.

The precharging circuit 110 provides precharge currents corresponding to the display data to the data lines D1 to D4 under control of the controller 102, thereby precharging the data lines D1 to D4.

The data driving circuit 112 includes a plurality of current sources IS1 to IS4, and provides data currents corresponding to the display data and outputted from the current sources IS1 to IS4 to the data lines D1 to D4 under control of the controller 102. As a result, the pixels E11 to E44 emit light.

The DC-DC circuit 116 boosts a battery voltage outputted from the battery 114 up to a driving voltage Vcc, and then outputs the boosted battery voltage.

FIG. 2A and FIG. 2B are views illustrating the process of driving the display device of FIG. 1. FIG. 2C is a timing diagram illustrating the process of driving the display device.

In FIG. 2A and FIG. 2C, the switches SW1 to SW4 are turned on, and the scan lines S1 to S4 are connected to a non-luminescent source having the same voltage V2 as the driving voltage Vcc. As a result, the data lines D1 to D4 are discharged up to the voltage of the zener diode ZD during a first discharge time dcha1.

Subsequently, the precharge circuit 110 provides precharge currents to the data lines D1 to D4 during a first precharge time pcha1, thereby precharging the discharged data lines D1 to D4.

Then, the first scan line S1 is connected to the ground as shown in FIG. 2A, and the other scan lines S2 to S4 are connected to the non-luminescent source. In addition, the switches SW1 to SW4 are turned off.

Subsequently, the data driving circuit 112 provides data currents I11 to I41 corresponding to first display data to the precharged data lines D1 to D4 during a first luminescent time t1. In this case, the data currents I11 to I41 are passed to the ground through the data lines D1 to D4, the pixels E11 to E41, and the first scan line S1. As a result, the pixels E11 to E41 related to the first scan line S1 emit light.

Then, the switches SW1 to SW4 are turned on during a second discharge time dcha2, and the scan lines S1 to S4 are connected to the non-luminescent source. As a result, the data lines D1 to D4 are discharged to the voltage of the zener diode ZD.

Subsequently, the precharging circuit 110 provides precharge currents to the discharged data lines D1 to D4 during a second precharge time pcha2, thereby precharging the discharged data lines D1 to D4.

Then, a second scan line S2 is connected to the ground, and the other scan lines S1, S3 and S4 are connected to the non-luminescent source. Additionally, the switches SW1 to SW4 are turned off.

Then, the data driving circuit 112 provides data currents I12 to I42 corresponding to second display data to the precharged data lines D1 to D4 during a second luminescent time t2 as shown in FIG. 2B, wherein the second display data is inputted to the controller 102 after the first display data is inputted to the controller 102. In this case, the data currents I12 to I42 are passed to the ground through the data lines D1 to D4, the pixels E12 to E42, and the second scan line S2. As a result, the pixels E12 to E42 related to the second scan line S2 emit light.

Pixels E13 to E43 corresponding to a third scan line S3 emit light through the method described above, and then pixels E14 to E44 corresponding to a fourth scan line S4 emit light. Subsequently, the above process of emitting light in the pixels E11 to E44 is repeated as one unit of the scan lines S1 to S4, i.e. a frame.

As described above, the data lines D1 to D4 are discharged up to a certain discharging voltage during a discharge time, i.e. electric charges charged to the data lines D1 to D4 are discharged and consumed. Thus, the battery 114 is consumed a lot, and accordingly, the power consumption of the display device becomes high.

BRIEF DESCRIPTION OF THE DRAWINGS

The above and other features and advantages of the present invention will become readily apparent by reference to the following detailed description when considered in conjunction with the accompanying drawings wherein.

DESCRIPTION OF EMBODIMENTS

Hereinafter, the preferred embodiments of the present invention will be explained in more detail with reference to the accompanying drawings.

Figure 1:
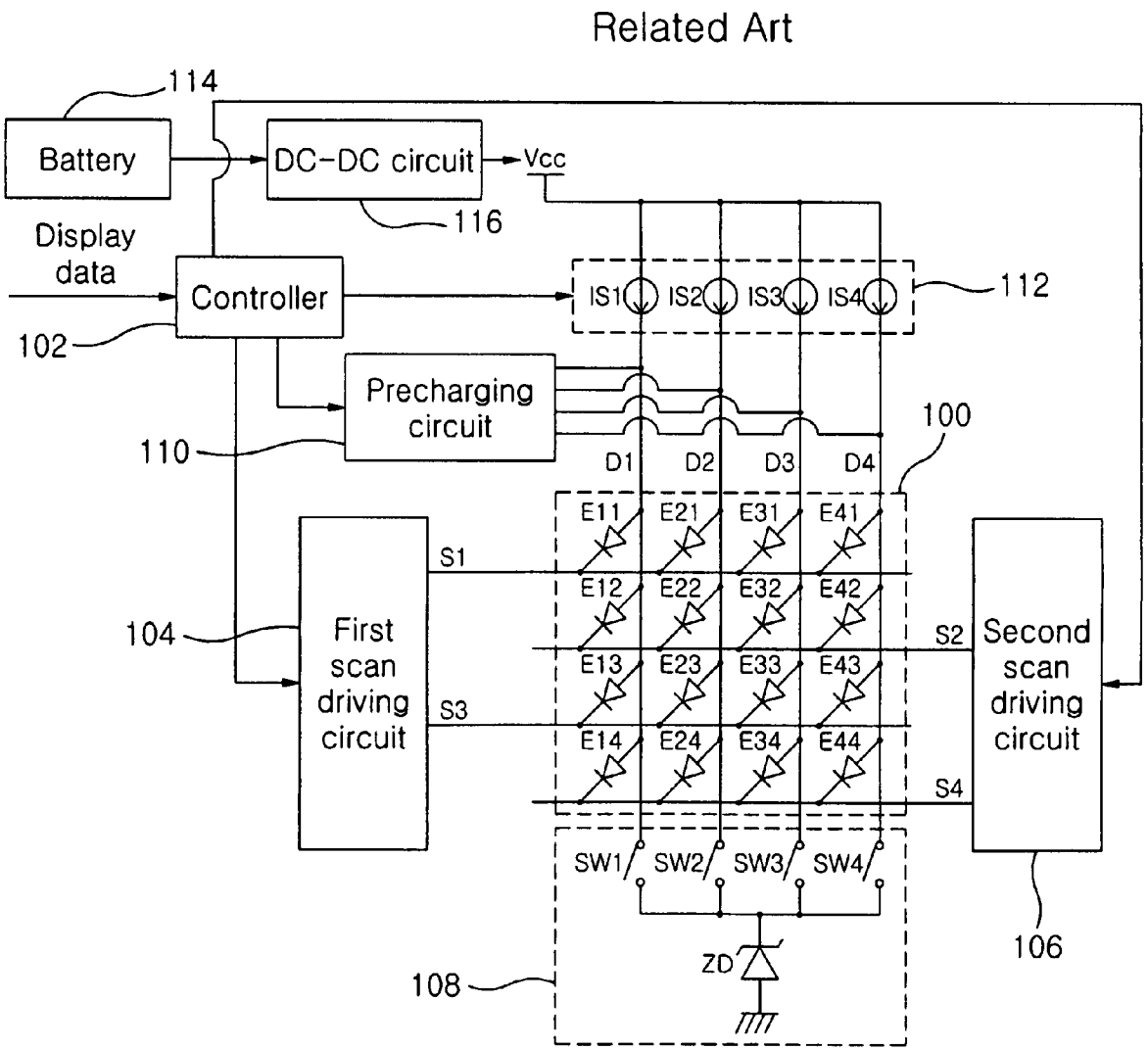
FIG. 1 is a view illustrating a common display device.
Figure 2A:
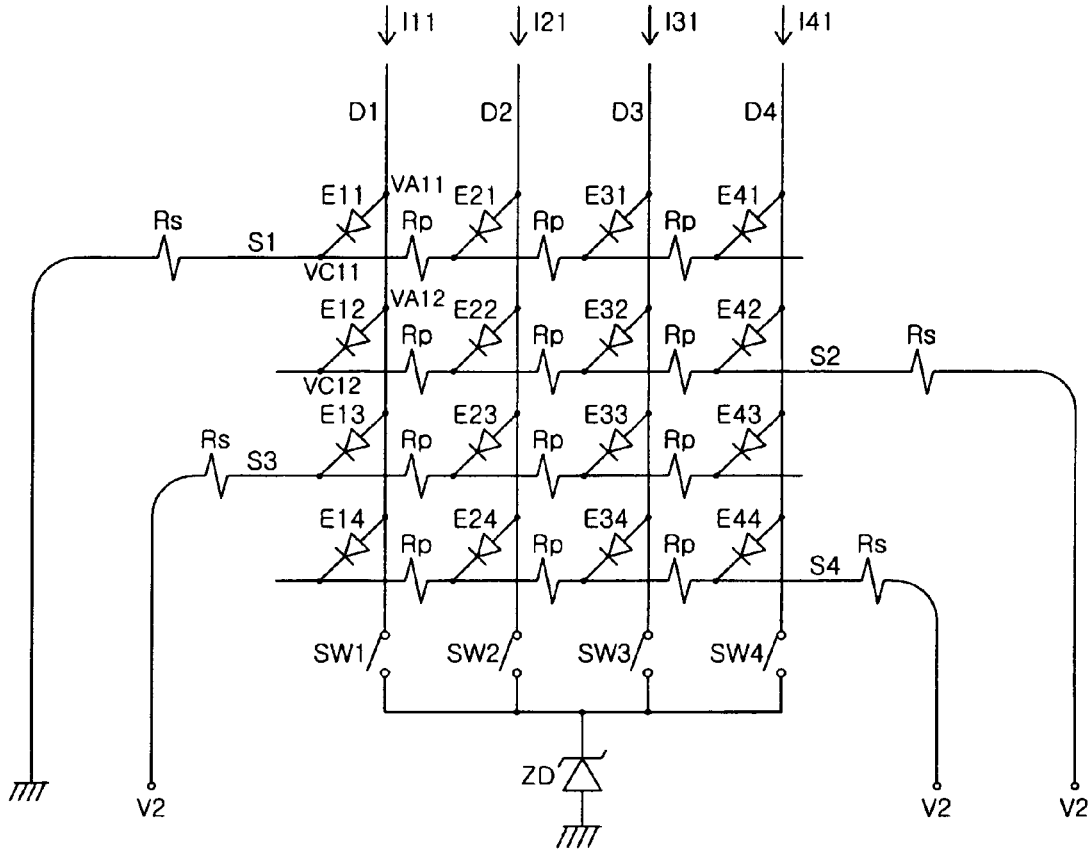
FIG. 2A Related Art
FIG. 2A and FIG. 2B are views illustrating the process of driving the display device of FIG. 1.
Figure 2B:
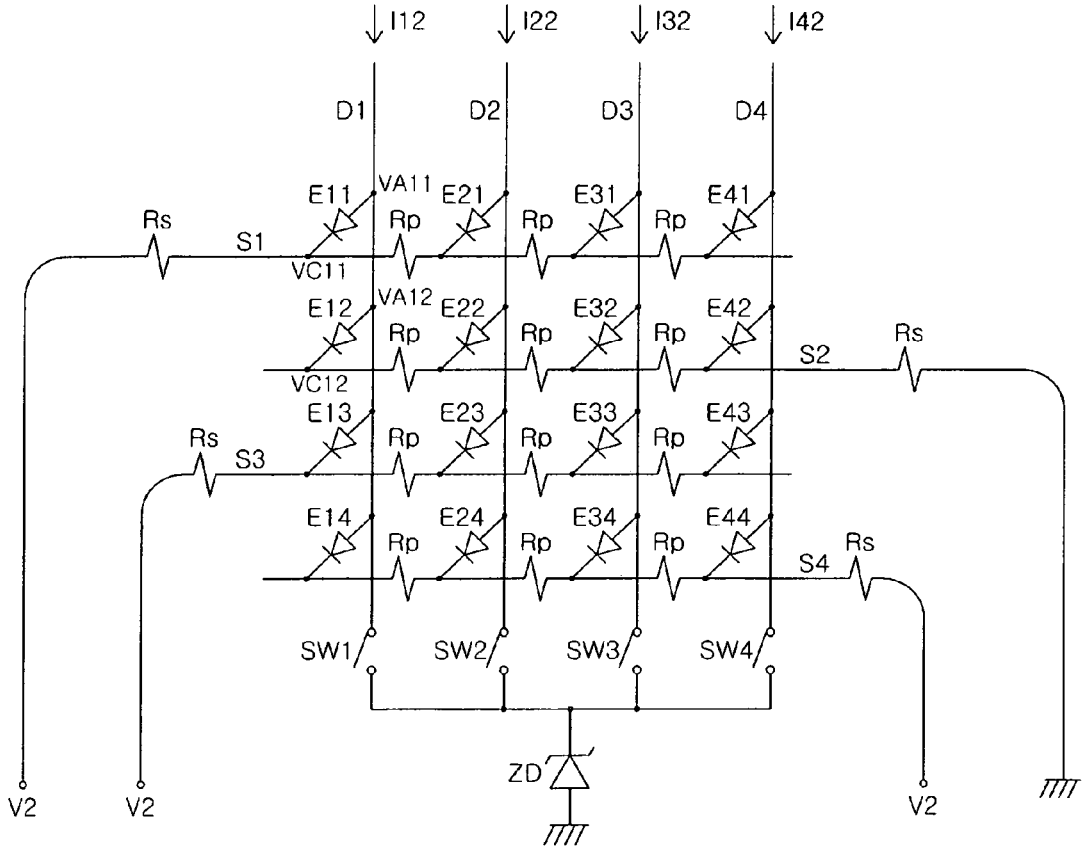
FIG. 2B Related Art
Figure 2C:
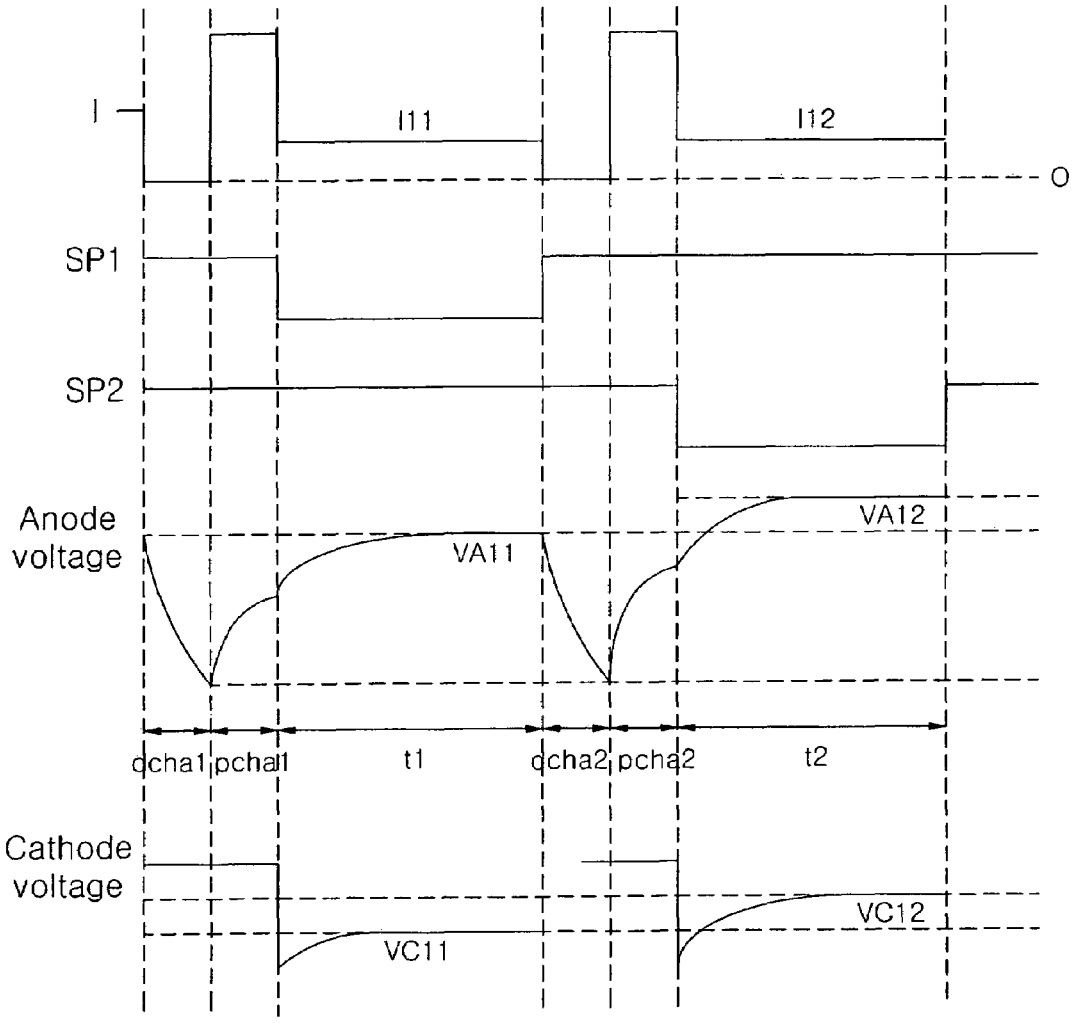
FIG. 2C Related Art
FIG. 2C is a timing diagram illustrating the process of driving the display device.
Figure 3:
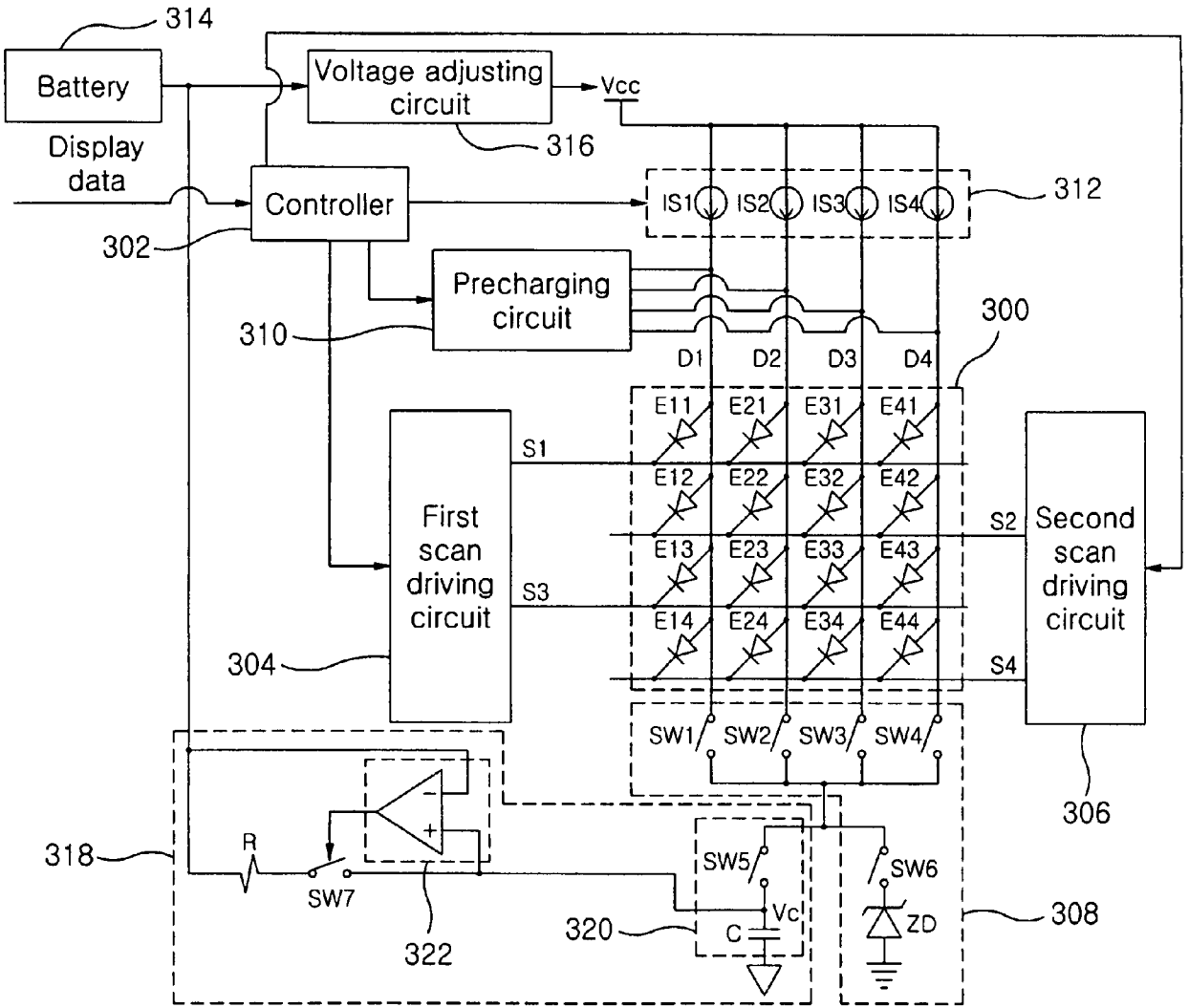
FIG. 3 is a view illustrating a display device according to a first embodiment of the present invention.

FIG. 3 is a view illustrating a display device according to a first embodiment of the present invention.

In FIG. 3, the display device of the present embodiment includes a panel 300, a controller 302, a first scan driving circuit 304, a second scan driving circuit 306, a discharging circuit 308, a precharging circuit 310, a data driving circuit 312, a battery 314, a voltage adjusting circuit 316 and a feedback circuit 318.

The display device according to one embodiment of the present invention includes an organic electroluminescent device, a plasma display panel, a liquid crystal display, and others. Hereinafter, the organic electroluminescent device will be described as an example of the display device for the convenience of description.

The panel 300 includes a plurality of pixels E11 to E44 formed in cross areas of data lines D1 to D4 and scan lines S1 to S4.

In case that the display device is organic electroluminescent device, each of the pixels E11 to E44 has a first electrode layer, an organic layer made up of organic material, and a second electrode layer formed in sequence on a substrate.

One of the first electrode layer and the second electrode layer is positive electrode, and the other layer is negative electrode.

When certain voltages are applied to the first electrode layer and the second electrode layer, holes generated from the positive electrode and electrons generated from the negative electrode are combined in the organic layer to form excitons. Then, the excitons are decomposed, and so a light having a certain wavelength is emitted from the organic layer in the decomposition process.

The controller 302 receives display data from an outside apparatus (not shown), and controls the scan driving circuits 304 and 306, a precharging circuit 310, and the data driving circuit 312 by using the received display data. Here, the controller 302 may store the received display data.

The first scan driving circuit 304 provides first scan signals to some of the scan lines S1 to S4, e.g. S1 and S3 under control of the controller 302.

The second scan driving circuit 306 provides second scan signals to the other scan lines S2 and S4 under control of the controller 302. As a result, the scan lines S1 to S4 are coupled in sequence to a luminescent source, e.g. ground.

The discharging circuit 308 includes switches SW1 to SW4, SW6 and a zener diode ZD, and discharges the data lines D1 to D4 up to the voltage of the zener diode ZD. Hereinafter, this discharging process will be described in detail with reference to the accompanying drawings.

The precharging circuit 310 provides precharge currents corresponding to the display data to the data lines D1 to D4 under control of the controller 302, thereby precharging the data lines D1 to D4.

The data driving circuit 312 includes a plurality of current sources IS1 to IS4, and provides data signals, e.g. data currents corresponding to the display data and outputted from the current sources IS1 to IS4, to the data lines D1 to D4 under control of the controller 302. As a result, the pixels E11 to E44 emit light. Here, the data signals have a level of not higher than the driving voltage Vcc, and are synchronized with the scan signals.

The voltage adjusting circuit 316 boosts a battery voltage outputted from the battery 314 up to the driving voltage Vcc, and generates the driving voltage Vcc. For example, the voltage adjusting circuit 316 is DC-DC circuit.

The feedback circuit 318 feeds electric charges discharged from the data lines D1 to D4 back to the battery 314, and includes a charge storing circuit 320, a comparing circuit 322 and a switch SW7. Hereinafter, the function of the feedback circuit 318 will be described in detail with reference to the accompanying drawings.

As described above, unlike the display device in the Related Art which consumes electric charges discharged from the data lines D1 to D4, the display device of the present invention feeds electric charges discharged from the data lines D1 to D4 back to the battery 314. Accordingly, the power consumption of the display device of the present invention is reduced, compared with the display device in the Related Art, and so the life of the battery 314 may be increased.

Figure 4A:
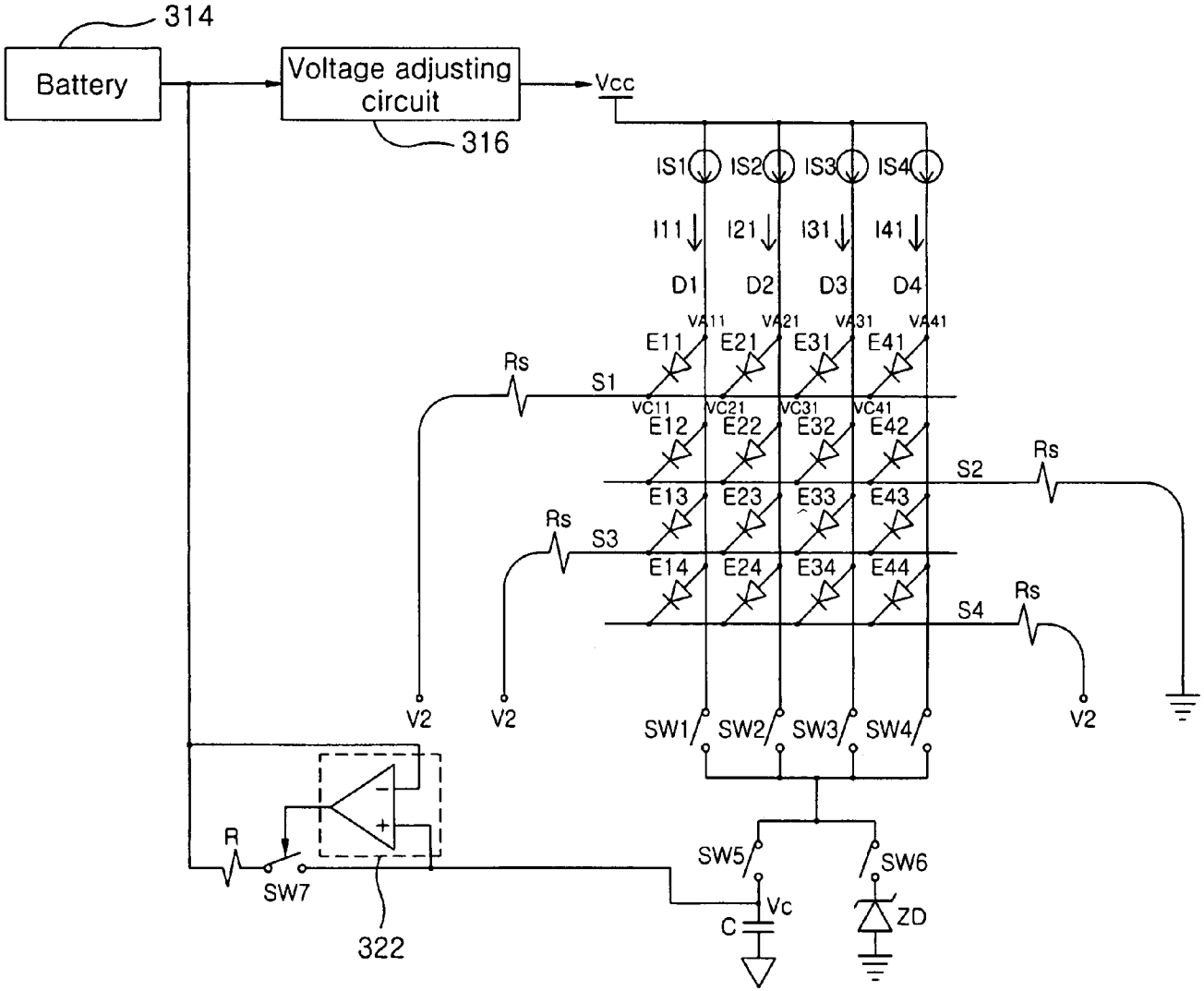
FIG. 4A and FIG. 4B are views illustrating the process of driving the display device in FIG. 3.
Figure 4B:
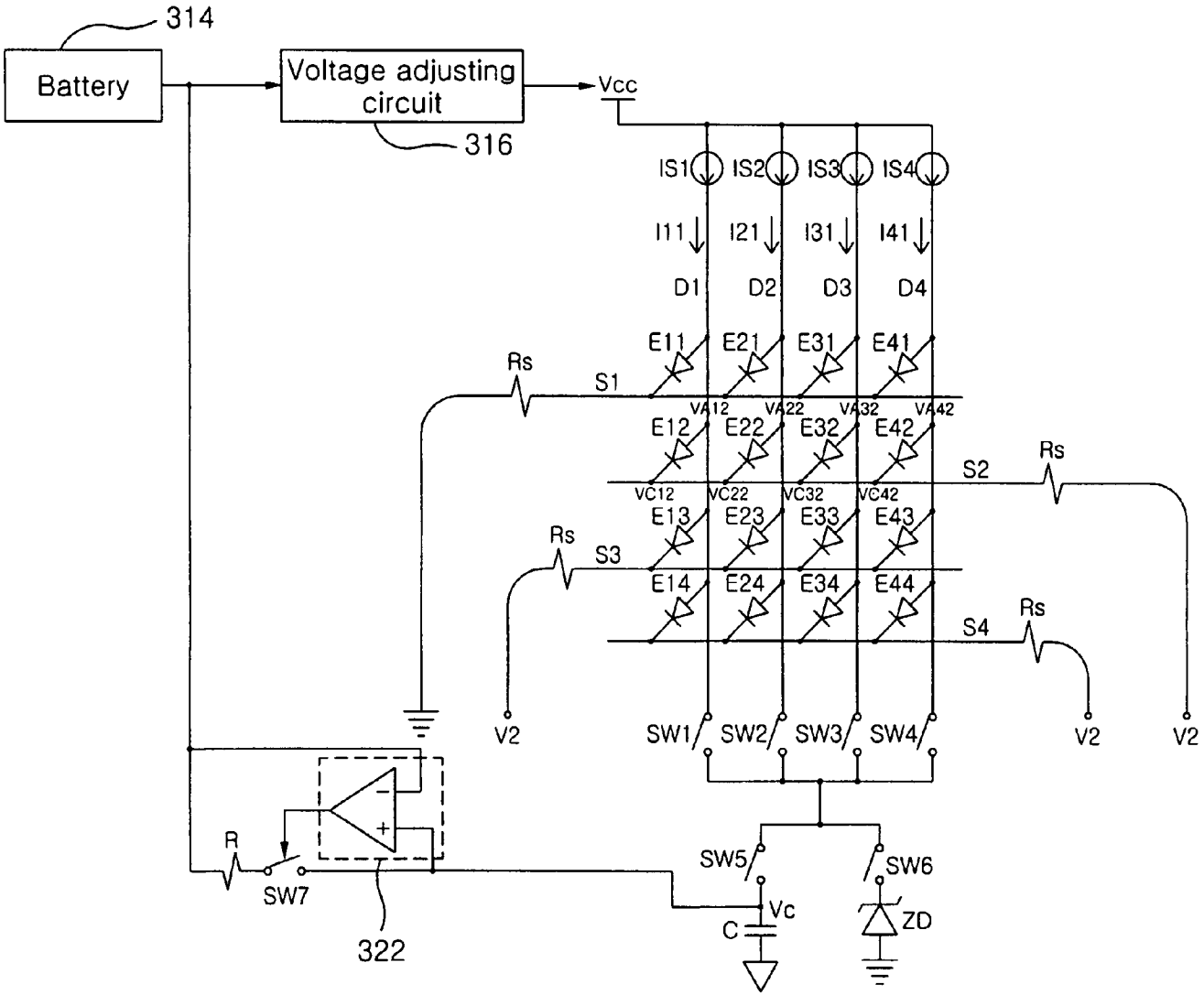
Figure 4C:
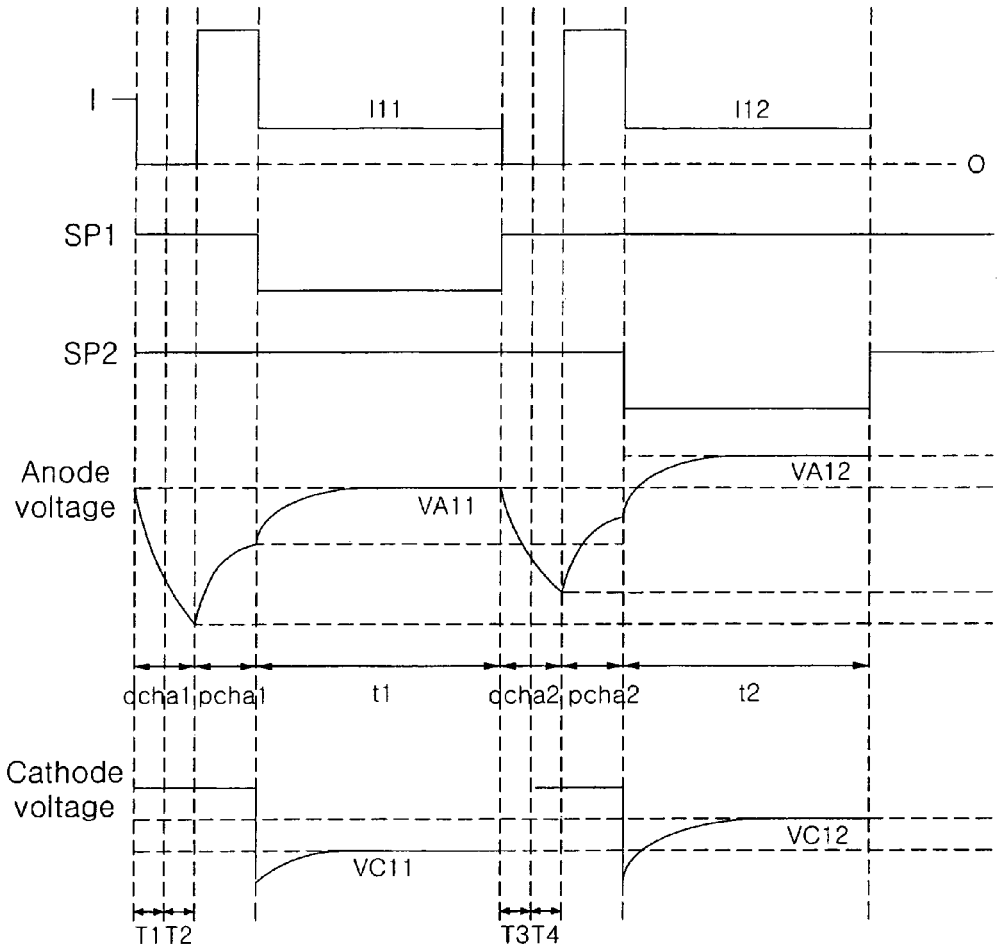
FIG. 4C is a timing diagram illustrating the process of driving the display device.

FIG. 4A and FIG. 4B are views illustrating the process of driving the display device in FIG. 3. FIG. 4C is a timing diagram illustrating the process of driving the display device.

In FIG. 4A and FIG. 4C, the switches SW1 to SW5 are turned on during a first sub-discharge time of a first discharge time dcha1, and the scan lines S1 to S4 are coupled to a non-luminescent source having the same magnitude V2 as the driving voltage Vcc. As a result, electric charges charged to the data lines D1 to D4 are stored in a capacitor C included in the charge storing circuit 320 during the first sub-discharge time T1 of a first discharge time t1.

Subsequently, the switches SW1 to SW4 maintain the 'turn-on' condition during a second sub-discharge time T2 of the first discharge time dcha1, the switch SW5 is turned off, and the switch SW6 is turned on. As a result, the data lines D1 to D4 are discharged up to the voltage of the zener diode ZD. In this case, a switching circuit SW7 may be turned on or off.

Hereinafter, the function of the switching circuit SW7 will be described in detail.

The comparing circuit 322 compares the battery voltage outputted from the batter 314 with a charging voltage Vc corresponding to electric charges stored in the capacitor C. For instance, the comparing circuit 322 compares the battery voltage with the charging voltage Vc by using OP amplifier.

In case that the charging voltage Vc is more than the battery voltage, the switching circuit SW7 is turned on. As a result, the electric charges stored in the capacitor C are moved into the battery 314 during the second sub-discharge time T2, and so the moved charges are charged to the battery 314.

However, in case that the charging voltage Vc is lower than the battery voltage, the switching circuit SW7 is turned off. That is, in case that the switching circuit SW7 is turned on, electric charges charged in the battery 314 are moved into the capacitor C since the battery voltage is higher than the charging voltage Vc. Then, the power consumption of the display device is increased, contrary to the object of the present invention. Generally, this phenomenon may be occurred when pixels related to the data lines D1 to D4 emit light having low brightness. Accordingly, if the charging voltage Vc is higher than the battery voltage though the pixels emit light having low brightness, the display device may not include the comparing circuit 322.

Hereinafter, the process of driving the display device of the present embodiment will be described.

The precharging circuit 310 provides precharge currents to the discharged data lines D1 to D4 during a first precharge time pcha1, thereby precharging the discharged data lines D1 to D4.

Then, the first scan line S1 is coupled to a luminescent source, e.g. ground, the other scan lines S2 to S4 are coupled to the non-luminescent source, and the switches SW1 to SW4 are turned off.

Subsequently, the data driving circuit 312 provides data currents I11 to I41 corresponding to first display data to the precharged data lines D1 to D4 during a first luminescent time t1. These data currents I11 to I41 are passed to the luminescent source through data lines D1 to D4, the pixels E11 to E14, and the first scan line S1. As a result, each of the pixels E11 to E41 related to the first scan line S1 emits light having brightness corresponding to the difference of its anode voltage VA11 to VA41 and its cathode voltage VC11 to VC41. Here, the data currents I11 to I41 are synchronized with a scan signal SP1, e.g. the data currents I11 to I41 are provided to the data lines D1 to D4 during low logic area of the scan signal SP1.

Then, the switches SW1 to SW5 are turned on during a first sub-discharge time T3 during a second discharge time dcha2, and the scan lines S1 to S4 are coupled to the non-luminescent source. As a result, electric charges charged to the data lines D1 to D4 are stored in the capacitor C included in the charge storing circuit 320 during the first sub-discharge time T3.

Subsequently, the switches SW1 to SW4 maintain the 'turn-on' condition during a second sub-discharge time T4 of the second discharge time dcha2, the switch SW5 is turned off, and the switch SW6 is turned on.

Consequently, the data lines D1 to D4 are discharged up to the voltage of the zener diode ZD. In this case, the comparing circuit 322 compares the battery voltage outputted from the battery 314 with a charging voltage Vc corresponding to the electric charges stored in the capacitor C. In case that the charging voltage Vc is more than the battery voltage in accordance with the comparison result, the switching circuit SW7 is turned on. Accordingly, the electric charges in the capacitor C are moved into the battery 314 during the second sub-discharge time T4, and so the moved electric charges are charged into the battery 314.

Subsequently, the precharging circuit 310 provides precharge currents to the discharged data lines D1 to D4 during a second precharge time pcha2, thereby precharging the discharged data lines D1 to D4.

Then, the second scan line S2 is connected to the ground, the other scan lines S1, S3 and S4 are connected to the non-luminescent source, and the switches SW1 to SW4 are turned off.

Subsequently, the data driving circuit 312 provides data currents I12 to I42 corresponding to second display data to the precharged data lines D1 to D4 during a second luminescent time t2 as shown in FIG. 4B, wherein the second display data is inputted to the controller 302 after the first display data is inputted. These data currents I12 to I42 are passed to the luminescent source through the data lines D1 to D4, the pixels E12 to E42, and the second scan line S2. As a result, each of the pixels E12 to E42 related to the second scan line S2 emits light having brightness corresponding to the difference of its anode voltage VA12 to VA42 and its cathode voltage VC12 to VC42. Here, the data currents I12 to I42 are synchronized with a scan signal SP2, e.g. the data currents I12 to I42 are provided to the data lines D1 to D4 during low logic area of the scan signal SP2.

Pixels E13 to E43 corresponding to a third scan line S3 emit light in a similar method to the above. Then, pixels E14 to E44 corresponding to a fourth scan line S4 emit light. Subsequently, the above process of emitting light in the pixels E11 to E44 is repeated as one unit of the scan lines S1 to S4, i.e. frame unit. That is, the pixels E11 to E44 emit light as frame unit corresponding to one screen image of the display device, and so a certain image is displayed on a panel 300.

Figure 5:
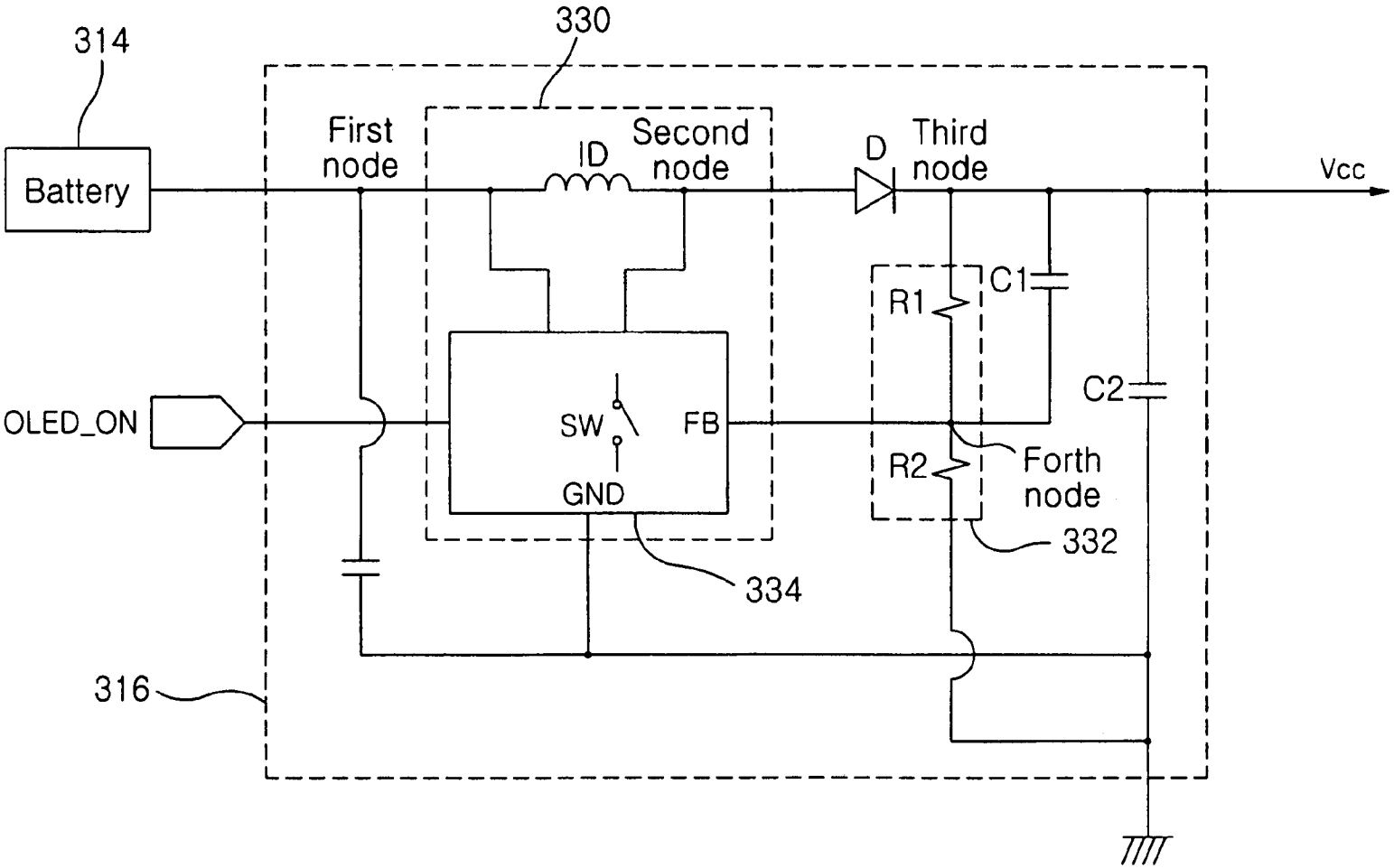
FIG. 5 is a view illustrating the voltage adjusting circuit in FIG. 3 according to one embodiment of the present invention.

FIG. 5 is a view illustrating the voltage adjusting circuit in FIG. 3 according to one embodiment of the present invention.

In FIG. 5, the voltage adjusting circuit 316 includes a boosting circuit 330 and a boosted voltage detecting circuit 332.

The boosting circuit 330 has an inductor ID and a boosting integrated circuit chip 334 coupled to both terminals of the inductor ID.

The boosting integrated circuit chip 334 has a switch SW, and boosts the battery voltage outputted from the battery 314 by switching the switch SW Here, since the boosting integrated circuit chip 334 is employed generally as boosting device, any further description concerning the elements of the boosting integrated circuit chip 334 except the switch SW will be omitted.

The boosted voltage detecting circuit 332 has resistors R1 and R2 coupled in series.

Hereinafter, the process of driving the voltage adjusting circuit 316 will be described in detail.

The switch SW is turned off, and so the battery voltage outputted from the battery 314 is stored in the inductor ID.

Subsequently, the switch SW is turned on, and so electric charges in the inductor ID are outputted to a second node.

Then, the switch SW is turned off, and so the battery voltage is stored in the inductor ID.

In other words, the switch SW repeats the turn-on/off, and so the battery voltage is boosted. Consequently, the second node has the boosted battery voltage. Here, the turn-on/off rate of the switch SW means the duty rate.

Subsequently, when the boosted battery voltage is more than the threshold voltage of a diode D, the booted battery voltage is passed to a third node through the diode D. As a result, the third node has the boosted battery voltage.

Then, the boosted voltage detecting circuit 332 detects the boosted battery voltage, i.e. the voltage of the third node.

Below, it is assumed that the voltage adjusting circuit 316 boosts the battery voltage, e.g. 3.7V, outputted from the battery 314 up to 18V, and a fourth node has 9V when the boosted battery voltage is 18V For example, in case that the battery voltage boosted by the boosting circuit 330 is 16V, the boosted voltage detecting circuit 332 detects that the fourth node has 8V.

Subsequently, the boosted voltage detecting circuit 332 provides the information concerning the detected voltage of the fourth node to a FB terminal of the boosting integrated circuit chip 334. In this case, the boosting integrated circuit chip 334 detects that the battery voltage is not boosted up to the desired voltage 18V through the provided information. Thus, the boosting integrated circuit chip 334 adjusts the duty rate of the switch SW to make the boosted battery voltage 18V.

The voltage adjusting circuit 316 boosts the battery voltage up to a desired voltage through the above described method, and outputs the boosted battery voltage, i.e. driving voltage Vcc.

Figure 6:
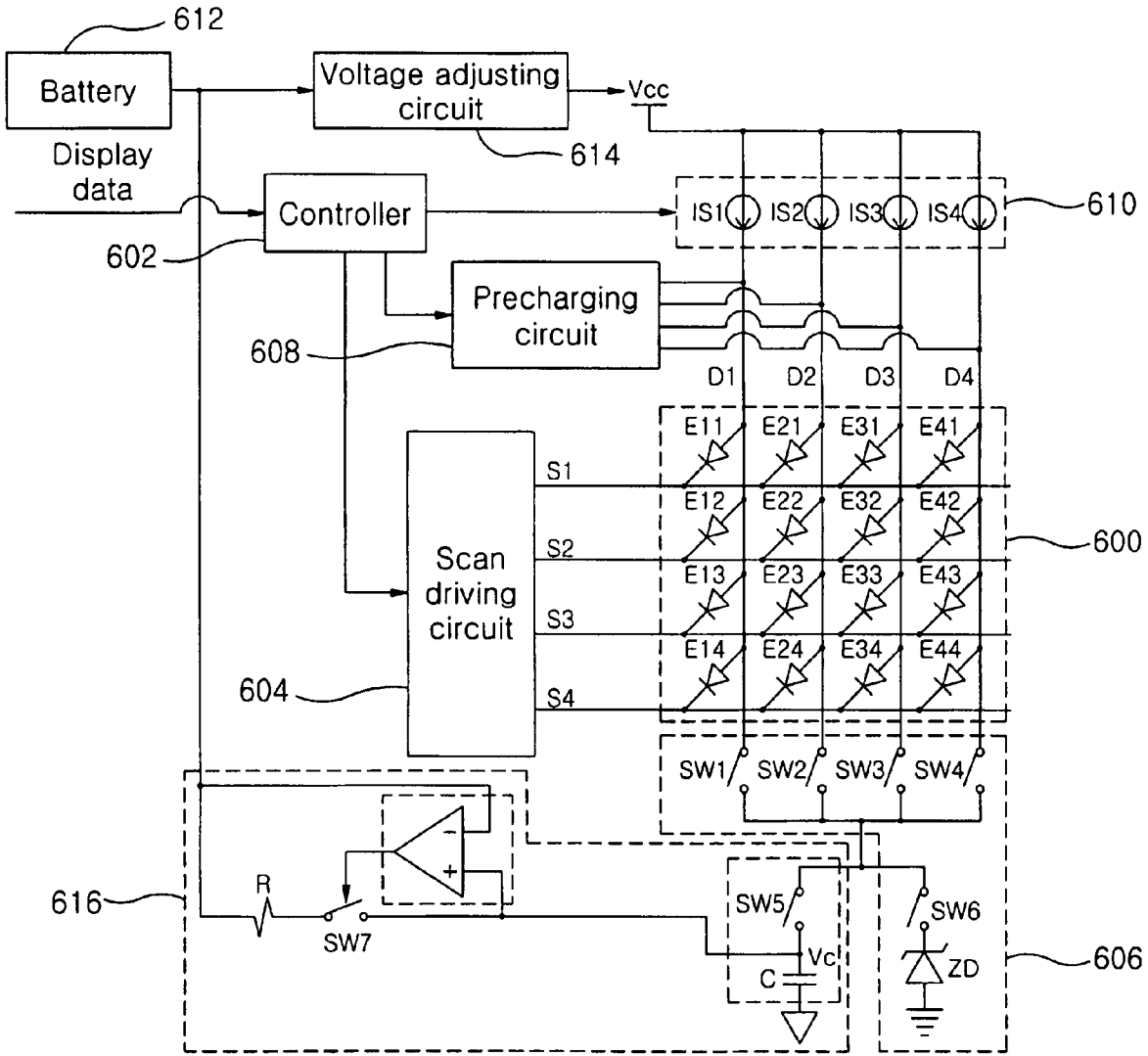
FIG. 6 is a view illustrating a display device according to a second embodiment of the present invention.

FIG. 6 is a view illustrating a display device according to a second embodiment of the present invention.

In FIG. 6, the display device of the present embodiment includes a panel 600, a controller 602, a scan driving circuit

604, a discharging circuit 606, a precharging circuit 608, a data driving circuit 610, a battery 612, a voltage adjusting circuit 614 and a feedback circuit 616.

Since the elements of the present embodiment except the scan driving circuit 604 are the same as in the first embodiment, any further description concerning the same elements will be omitted.

Unlike the scan driving circuit 304 and 306 in the first embodiment which is disposed in both directions of the panel 300, the scan driving circuit 604 in the second embodiment disposed in one direction of the panel 600 is as shown in FIG. 6.

An embodiment may be achieved in whole or in part by the display device comprising: data lines disposed in a first direction; scan lines disposed in a second direction different from the first direction; a plurality of pixels formed in cross areas of data lines and scan lines, and configured to drive on the basis of a driving voltage; a charge storing circuit connected to at least one data line during a first sub-discharge time of a discharge time, and configured to store charges discharged from the data line during the first sub-discharge time, wherein the discharge time includes at least two sub-discharge times; and a discharging circuit connected to the data line during a second sub-discharge time of the discharge time, and configured to discharge the data line up to a certain discharge voltage during the second sub-discharge time.

Another embodiment may be achieved in whole or in part by a circuit driving device for driving a panel having a plurality of pixels formed in cross areas of data lines and scan lines comprising: a charge storing circuit configured to store charges discharged from at least one of the data lines during a first sub-discharge time of a discharge time, wherein the discharge time includes at least two sub-discharge times; and a discharging circuit configured to discharge the data line up to a certain discharge voltage during a second sub-discharge time of the discharge time.

Still another embodiment may be achieved in whole or in part by a method of driving a display device having a plurality of pixels formed in cross areas of data lines and scan lines comprising: storing charges discharged from at least one of data lines during a first sub-discharge time of a discharge time, wherein the discharge time includes at least two sub-discharge times; and discharging the data line up to a certain discharge voltage during a second sub-discharge time of the discharge time.

As described above, the display device and the method of driving the same feed electric chares discharged from the data line back to the battery in discharging, and so the power consumption of the display device may be reduced.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device comprising:

data lines disposed in a first direction;

scan lines disposed in a second direction different from the first direction;

a plurality of pixels formed in cross areas of the data lines and the scan lines, and configured to drive on the basis of a driving voltage;

a charge storing circuit coupled to at least one data line during a first sub-discharge time of a discharge time, and configured to store charges discharged from the data line during the first sub-discharge time, wherein the discharge time includes at least two sub-discharge times;

a discharging circuit coupled to the data line during a second sub-discharge time of the discharge time, and configured to discharge the data line up to a certain discharge voltage during the second sub-discharge time;

a battery providing a battery voltage;

a voltage adjusting circuit configured to boost the battery voltage outputted from the battery and output the driving voltage, wherein charges stored in the charge storing circuit are provided to the battery during the second sub-discharge time;

a comparing circuit coupled to the battery and charge storing circuit, and configured to compare the battery voltage outputted from the battery with a charging voltage corresponding to charges stored in the charge storing circuit; and a switching circuit configured to switch the couple between the battery and the charge storing circuit in accordance with a comparison result of the comparing circuit, wherein the switching circuit turns off the couple between the battery and the charge storing circuit when the battery voltage is higher than the charging voltage, and the switching circuit turns on the couple between the battery and the charge storing circuit when the battery voltage is the same as, or less than the charging voltage.

2. The display device of claim 1, wherein the discharging circuit includes a zener diode coupled to the data line.

3. The display device of claim 1, wherein the comparing circuit includes an OP amplifier.

4. The display device of claim 1, wherein the charge storing circuit includes a capacitor.

5. The display device of claim 1, wherein one or more of the pixels include:

a first electrode as positive electrode;

a second electrode as negative electrode; and an organic layer disposed between the first electrode and the second electrode, and made up of organic material.

6. A circuit driving device for driving a panel having a plurality of pixels formed in cross areas of data lines and scan lines, comprising:

a charging storing circuit configured to store charges discharged from at least one of the data lines during a first sub-discharge time of discharge time, wherein the discharge time include at least two sub-discharge times;

a discharging circuit configured to discharge the data line up to a certain discharge voltage during a second sub-discharge time of the discharge time;

a voltage adjusting circuit configured to boost a battery voltage outputted from a battery, and output the driving voltage;

a data driving circuit configured to provide data currents to the data lines using the driving voltage outputted from the voltage adjusting circuit;

a comparing circuit configured to compare the battery voltage with a charging voltage corresponding to charges stored in the charge storing circuit; and a switching circuit configured to switch the couple between the battery and the charge storing circuit in accordance with a comparison result of the comparing circuit, wherein the switching circuit turns off the couple between the battery and the charge storing circuit when the battery voltage is higher than the charging voltage, and the switching circuit turns on the couple between the battery and the charge storing circuit when the battery voltage is the same as, or less than the charging voltage.

7. The circuit driving device of claim 6, wherein the comparing circuit includes an OP amplifier.

8. The display device of claim 6, wherein the charge storing circuit includes a capacitor.

9. The display device of claim 6, wherein the discharging circuit includes a zener diode coupled to the data line.

10. A method of driving a display device having a plurality of pixel formed in cross areas of data lines and scan line, comprising:

storing charges discharged from at least one of the data lines during a first sub-discharge time of a discharge time, wherein the discharge time includes at least two sub-discharge times;

discharging the data line up to a certain discharge voltage during a second sub-discharge time of the discharge time;

outputting driving voltage by boosting a battery voltage outputted from a battery; providing data currents to the data lines by using the driving voltage;

comparing the battery voltage with a charging voltage corresponding to the stored charges; and providing the stored charges to the battery when the charging voltage is the same as, or higher than, the battery voltage in accordance with the comparison result.

* * * * *